US006668939B2

(12) United States Patent
Schmidt et al.

(10) Patent No.: US 6,668,939 B2
(45) Date of Patent: Dec. 30, 2003

(54) PIERCING NOZZLE

(76) Inventors: Larry L. Schmidt, 26695 Light La., Conifer, CO (US) 80433; Roger L. Granat, P.O. Box 810, Pine, CO (US) 80470

( * ) Notice: Subject to any disclaimer, the term of this patent is extended or adjusted under 35 U.S.C. 154(b) by 0 days.

(21) Appl. No.: 10/162,100

(22) Filed: Jun. 4, 2002

(65) Prior Publication Data

US 2002/0179307 A1 Dec. 5, 2002

Related U.S. Application Data

(60) Provisional application No. 60/295,752, filed on Jun. 4, 2001.

(51) Int. Cl.[7] ..... A62C 11/00

(52) U.S. Cl. ..... 169/70; 169/54; 239/271; 239/276; 239/567

(58) Field of Search ..... 169/54, 70; 239/271, 239/276, 567

(56) References Cited

U.S. PATENT DOCUMENTS 2,224,010 A * 12/1940 Barber ..... 239/271

5,062,486 A * 11/1991 McClenahan ..... 169/70

* cited by examiner

*Primary Examiner*—Robin O. Evans

(74) *Attorney, Agent, or Firm*—Dorr, Carson, Sloan, Birney & Kramer, P.C.

(57) ABSTRACT

The invention is a piece of firefighting equipment called a piercing nozzle. The piercing nozzle comprises a hollow tube connected to a hose and adapted for conveying water or other fire suppressant fluid near a pointed head adapted to penetrate a barrier and to release the water or fire suppressant fluid in an adjoining room. The pointed head contains a plurality of holes angled in various directions so as to spray the fire suppressant fluid over a wide area in the adjoining room so as to protect firefighters from flames or superheated air when they enter the adjoining room. The pointed head may be shaped like a cone attached to which is a plurality of sharp blades designed to facilitate penetration of the barrier. Attached to the hollow tube is a sliding weight with handles used for pounding the pointed head through the barrier.

20 Claims, 5 Drawing Sheets

PIERCING NOZZLE

The within application is based upon the provisional application, Serial No. 60/295,752, on the same name and inventor, filed on Jun. 4, 2001 in the U.S. Patent and Trademark Office.

BACKGROUND B FIELD OF INVENTION

The invention is a firefighting device, which enables firefighters who need to penetrate a wall or door in the process of firefighting to inject water or other fire suppressing fluid into a room beyond the wall or door in order to extinguish a fire or reduce the temperature of superheated air, which may exist beyond the door or wall. After use of the firefighting device, the firefighters may safely break down the door or wall without the risk that flames or superheated air will escape through the opening created by breaking down the door or wall, thus injuring the firefighters. The invention also has electrical insulation on its critical parts including the handles held by the firefighter to reduce the risk of electric shock to the firefighter in case the piercing nozzle contacts an electric wire inside the door or wall in the process of penetrating it.

BACKGROUND B DESCRIPTION OF PRIOR ART

Firefighting equipment includes hoses and nozzles of various kinds designed to pour water or fire suppressant fluid on an open area visible to the firefighters.

Firefighting equipment also includes hatchets, axes and other tools designed to break down doors or walls. However, when hatchets or other similar devices are used to break down the wall, fire or superheated air may escape from the adjoining room and burn the firefighters before they can use a hose or nozzle to reduce or extinguish the fire on the other side of the wall. Additional products that are available include a ram apparatus that is forced into a closed room or space by way of hitting it rear portion with a sledgehammer, similar to a hammer hitting a nail.

The ram approach has numerous disadvantages including that the use of a sledgehammer is itself dangerous. Swinging a 20-pound sledge in wet, dangerous and chaotic surroundings is likely to injure the person using the hammer or the person holding the ram. Also the procedure requires that the sledge (a separate tool) be carried with the ram. Further the ram method requires at least two people for its operation.

The invention is novel because it addresses the shortcoming of the prior methods, and gives a safe means of piercing a wall or door, to then suppress the potential life threatening circumstances that may await the firemen on the other side. All of this is done in a self-contained apparatus that can be operated by one individual. The piercing nozzle allows the introduction of the suppression fluid without subjecting the firemen to the superheated air and toxic smoke.

SUMMARY OF INVENTION

The invention comprises a hollow tube, a sharp pointed head on one end of the tube, and a sliding weight, which moves back and forth along the tube, so that the impact of the sliding weight against stops on the tube drives the pointed head and tube through a wall or door. Also the weight has the ability to be used to remove the tube if it gets stuck during its use. The pointed head, or the end of the tube, has holes, which spray water, introduced into the tube at the rear end of the tube, or other firefighting fluid into the area beyond the door or wall.

OBJECTS AND ADVANTAGES

The objects of the present invention are:

1. To help firefighters gain access to an adjoining room behind a door or wall safely without the risk of fire or superheated air burning them when they create an opening in the door or wall.
2. To efficiently extinguish or suppress fire which may exist behind a door or wall with almost no danger to the firefighters.
3. To make a small initial opening in a door or wall for the purpose of injecting water or fire suppressing fluid into an adjoining room.
4. To provide a light-weight, small, portable device for penetrating a door or wall capable of operation by one person and adapted for connection to a water hose or similar source of firefighting fluid.
5. To provide protection from electric shock to the firefighter operating the device in case the device contacts an electrical wire in the process of penetrating the door or wall.
6. To provide a very sharp device for easily penetrating a door wall without undue hand pressure from the operator.
7. To provide a nozzle, which will spray water or fire suppressant fluid in many different directions once it has penetrated a wall or door.
8. To provide a wall or door penetrating device which does not require electric or other power, but can be operated easily by hand by a single firefighter.
9. To provide a single apparatus, with all of its essential elements, so that the piercing operation may be accomplished, without the worry of losing essential operating components.
10. To provide an apparatus to anticipate the needs of firefighters, in the midst of trying to put out a fire, that is both simple to use and with options to address the foreseeable hazards such as having the apparatus get wedged in a location and being able to use the same weight used to drive the apparatus into the door or wall as an efficient tool to remove the apparatus Still further objects and advantages will become evident from the detailed description of the invention, and the drawings.

DRAWING FIGURES

DETAILED DESCRIPTION OF THE DRAWINGS

Figure 3:
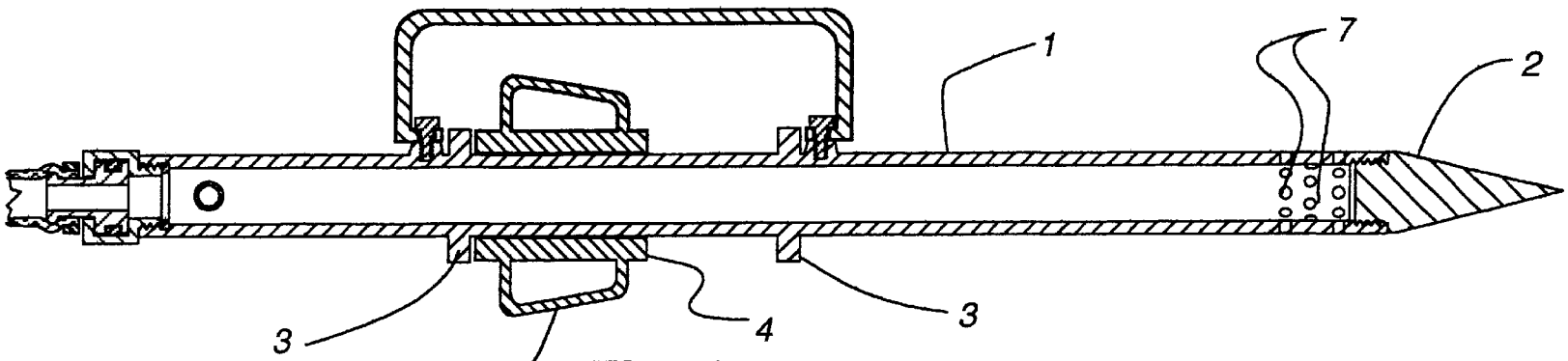
FIG. 3 shows the pointed head with the nozzle holes in the tube pointing in different directions and the screw mount the replaceable point.
Figure 5:
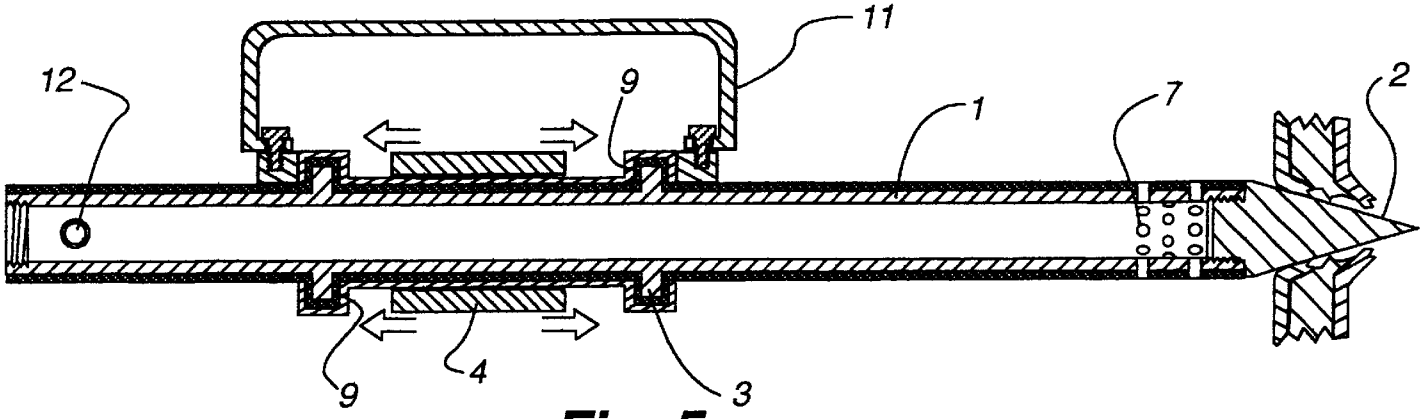
FIG. 5 shows the weight being hammered back and forth against stops.
Figure 8:
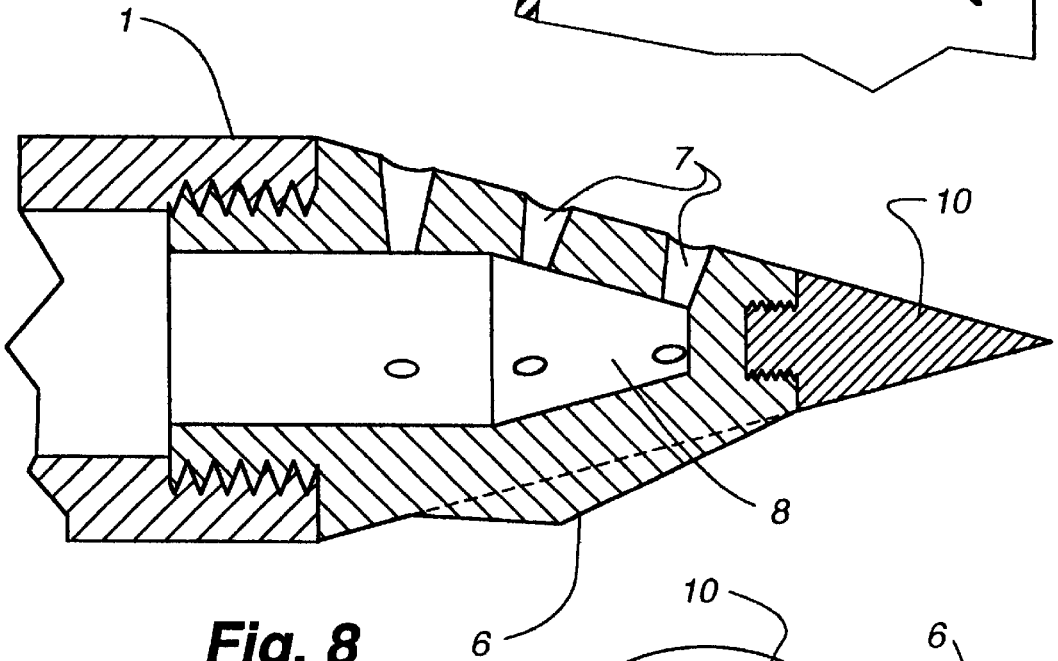
FIG. 8 shows the pointed head with holes and the hollowed out interior to allow passage of fluid. The embodiment also has a replaceable tip.

FIG. 5 is an overall view of the invention showing the hollow nozzle tube 1, the hole in the back-end 12 is to use for pulling the nozzle tube if stuck, the pointed head 2, the weight stops 3, and the sliding weight 4. The hole in the rear of the tube 12 is to attach a rope, chain or bar to enable a user to pull out a nozzle tube from a wall, door or other surface that has been penetrated. FIG. 8 shows another embodiment with holes 7 in the pointed head and blades 6; and the pointed head 2 with replaceable point 10, and the head cavity 8. FIG. 5 illustrates an electrical or other insulating coating 9 applied to the weight 4 and the tube to prevent shocker heat from being transmitted to the user. FIG. 3 shows the sliding weight 4, weights stops 3 and the carry handle 11 and the weight handles 5.

Description—Preferred Embodiment

Figure 9:
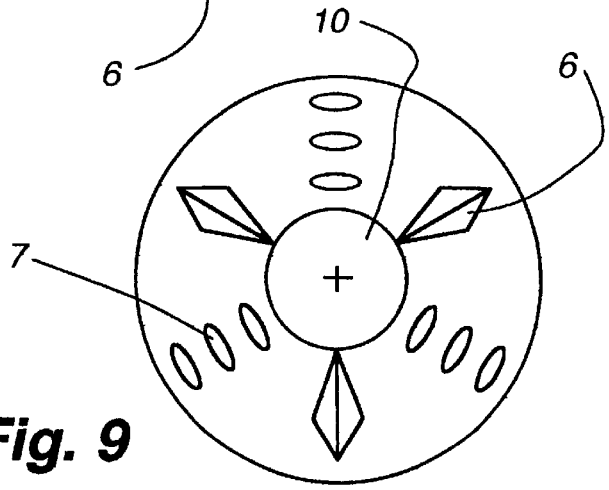
FIG. 9 shows an axial view from the tip of the pointed head of FIGS. 7 and 8.
Figure 10:
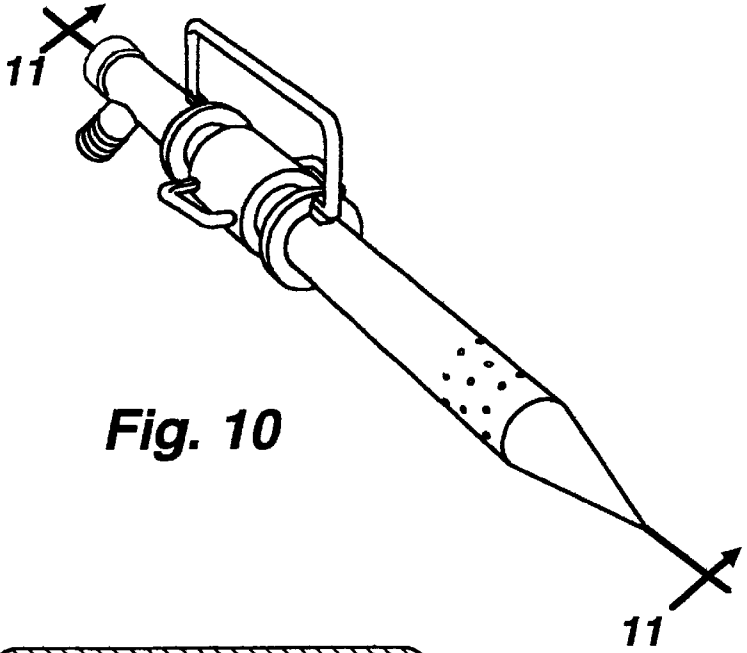
FIG. 10 shows another embodiment with the water or fluid attachment connection on the side of the tube. This allows the use of a sledge applied to the back plate to help drive the apparatus through a wall or barrier.
Figure 11:
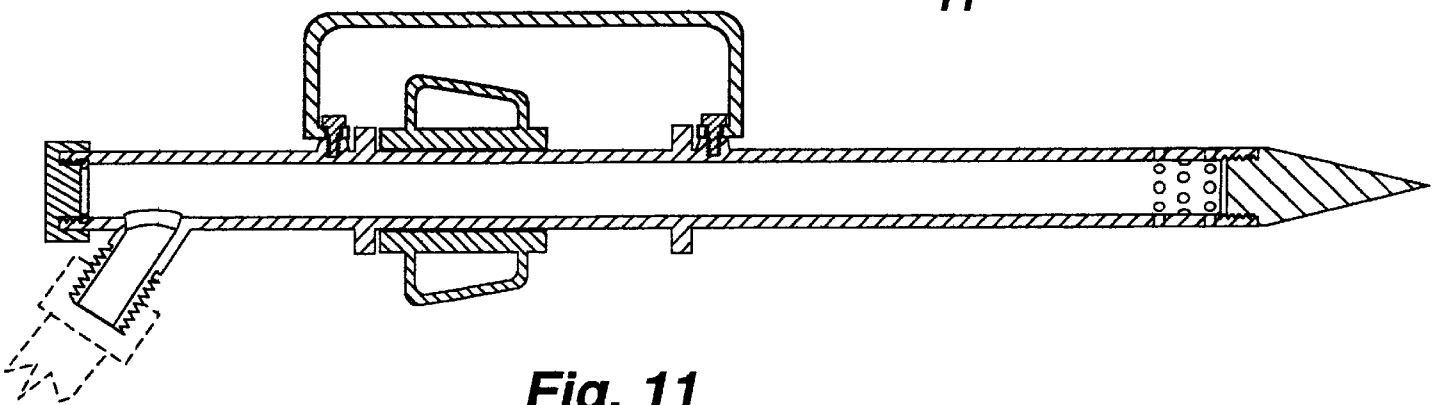
FIG. 11 shows a cutaway view of FIG. 10.

In the preferred embodiment of invention, generally shown in FIG. 3, the nozzle tube 1 is a hollow tube made of a strong metal and is connected to pointed head 2. The end of the nozzle tube 1 away from the pointed head 2 is attached to a hose, which brings water or other firefighting fluid into the nozzle tube 1 under pressure. The water is conveyed to the nozzle holes 7 and then is sprayed in a number of different directions by nozzle holes which are angled in varying directions. In normal operation, the water is not turned on until the pointed head 2 has penetrated the door or wall. The sharply pointed head 2 are adapted to penetrate a wall without extreme pressure by the operator. The penetration of the wall is facilitated by the reciprocating impact of the sliding weight 4. The operator grasps the weight handles 5 with his hands and moves the sliding weight 4 back and fourth in a reciprocating motion so that the sliding weight 4 impacts the weight stop 3 with a substantial force, thus driving the nozzle tube 1 and pointed head 2 farther into the wall. The pointed head 2 can be fitted with a number of blades 6 as shown in FIGS. 8 and 9 spaced around the axis of the pointed head. Typically three or four such head blades 6 are used on the pointed head 2. These blades may be machined from one piece of metal at the same time that the pointed head is formed. Alternatively, the head blades 6 may be attached to the pointed head 2 by inserting them into grooves in the pointed head 2 or by welding. In the preferred embodiment FIG. 5, the sliding weight 4 has electrical insulating coating on the tube. Such insulating coating may also be applied to the weight handles 5, and it also may be applied to the generally cylindrical interior of the sliding weight 4, which is in contact with the nozzle tube 1. Thus, if the nozzle tube 1 or pointed head 2 comes into contact with an electrical wire inside the wall, the electricity will not be conveyed to the hands of the operator because of the insulating coating on the tube, the weight handles 5, the interior of the sliding weight 4. This insulation also may protect against heat being transmitted along the exterior of the tube where it could touch an operator and cause burns.

Operation of the Invention

Figure 4:
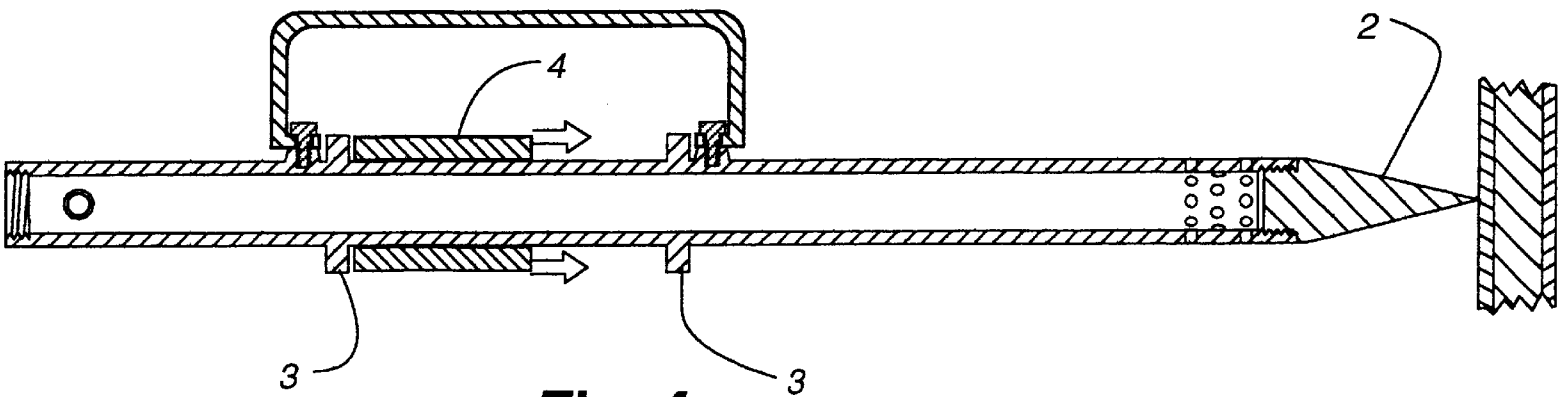
FIG. 4 shows the weight, which slides along the nozzle tube and is fitted with two handles for grasping by the firefighter and the pointed head ready to penetrate a wall which help force the pointed head number to penetrate the wall. This picture also illustrates the use of an insulation barrier to protect users.
Figure 6:
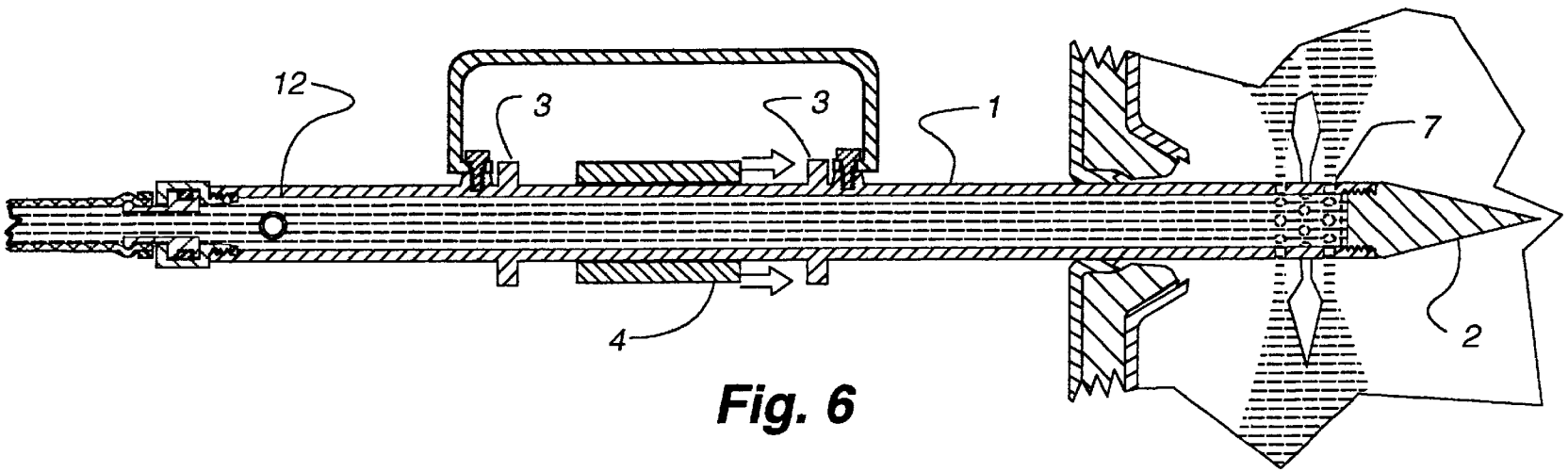
FIG. 6 shows the full penetration of the wall and the water or fluid being sprayed into the room.

FIG. 3 shows the device for purposes of the description of operation. To use the device, the operator connects the nozzle tube 1 to a hose containing water or other firefighting fluid at the open end of the nozzle tube away from the pointed head 2. The operator then grasps the weight handles 5 with his hands and positions the pointed head 2 in contact with the wall or door to be penetrated as shown in FIG. 4. The operator, grasping weight handles 5, pushes the sliding weight 4 into weight stop 3 so as to provide a substantial impact against forward weight stop 3. This forces the nozzle tube 1 and pointed head 2 into the wall to be penetrated as in FIG. 5. The pointed head 2 may aid in the penetration of the wall by head blades 6, FIG. 7. Both the point of the pointed head 2 and the leading edge of head blades 6 are very sharp and hard. The operator then slides the sliding weight 4 back to near the rear weight stop 3, and then slides the sliding weight 4 again towards the pointed head 2 with sufficient force and velocity to provide a substantial impact against weight stop 3, FIG. 6, thus forcing the nozzle tube 1 and pointed head 2 farther into the wall to be penetrated. The process is repeated by the operator a number of times, and repeated sliding of the sliding weight 4 and impact against the forward weight stop 3 forces the pointed head 2 farther into the wall. Once the wall has been penetrated completely by pointed head 2, the operator operates a valve on the hose, not shown, which allows water or other firefighting fluid to flow through the nozzle tube 1 into the nozzle holes 7, FIG. 6. Since the nozzle holes 7 are pointed in various different directions, the water is sprayed in many different directions in the room beyond the penetrated wall thus suppressing fire or cooling superheated air that may exist beyond the wall. After the fire is suppressed or the superheated air is cooled by the device, the firefighter may remove the device from the wall, and use an axe or hatchet to make a large hole in the wall without the danger that fire or superheated air will escape through the hole and burn the firefighter working to enlarge the hole. In this way, the hole can be progressively enlarged to the point where the firefighter himself may step through the door or wall and bring a water hose or other firefighting equipment with him into the adjoining room.

Additional Embodiments

Figure 7:
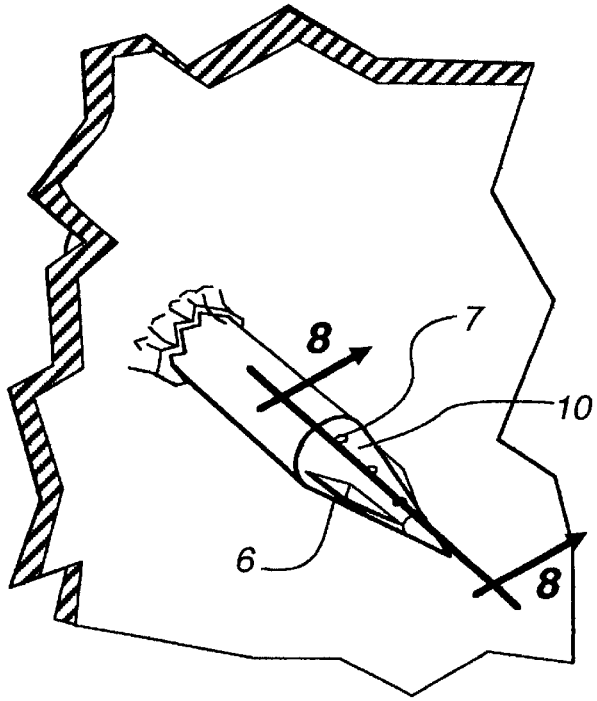
FIG. 7 shows an alternate pointed head with the fluid holes located in the head and with blades to help penetrate the wall.

As an additional embodiment, the invention has, for the spraying means, nozzle holes in the end pointed head 2 as shown in FIGS. 7, 8 and 9. The water or fluid may also be dispersed by means of a rotating collar such as a water sprinkler in the tube area or on the pointed head.

Alternative Embodiments

The invention may be made with varying numbers of head blades 6, FIGS. 7, 8 and 9, with pointed heads 2 with different lengths and point angles, and with varying surface hardening treatment and sharpening designed to penetrate walls or doors of varying resistance such as wood, plasterboard, metal, etc. Likewise, sliding weight 4 may have different sizes and masses including very large masses which may be required to provide enough impact against forward weight stop 3 to penetrate resistant walls. The pointed nozzle may have replaceable points 10 with any common means of attachment so that when the tip becomes dull it may be replaced, FIGS. 7, 8 and 9.

Conclusions, Ramifications and Scope

Figure 1:
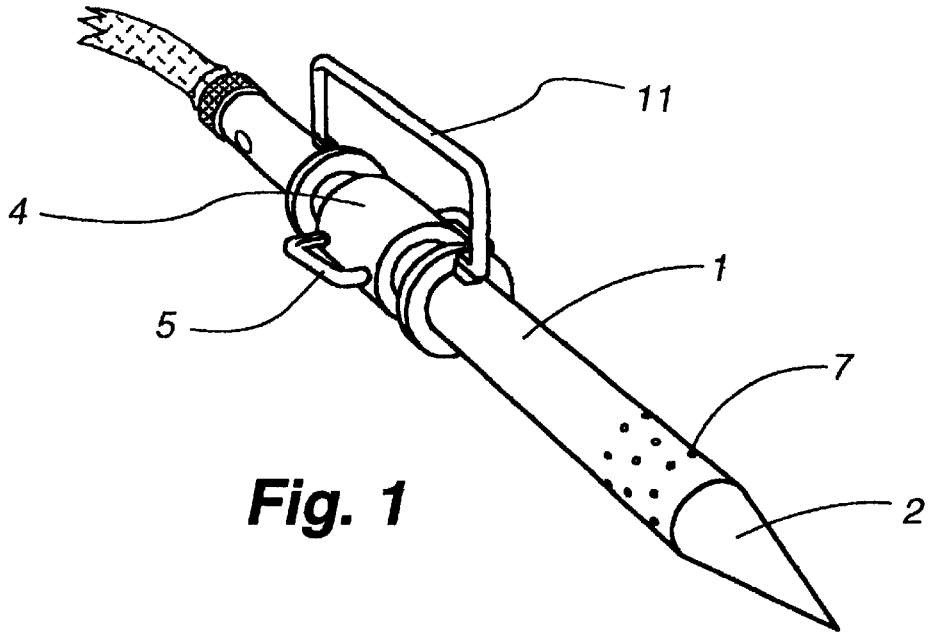
FIG. 1 is an overall view of the piercing nozzle showing the hollow nozzle tube with holes in the tube, the pointed head, and the sliding weight with handles. It shows a carry handle.
Figure 2:
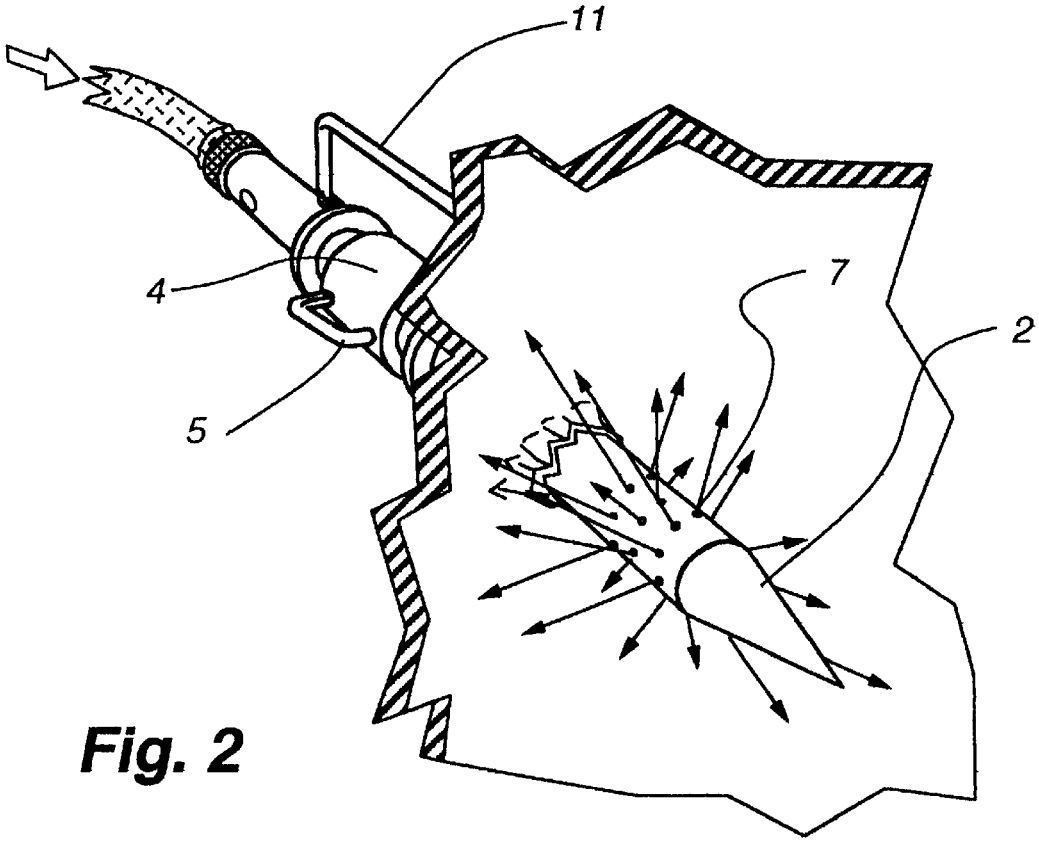
FIG. 2 is a detailed view of the pointed head attached to the end of the nozzle tube.

The various parts of the device including the weight handles 5, the sliding weight 4, the nozzle tube 1, the weight stops 3, and the pointed head 2 may be constructed of various materials of different weights and strengths. The handle means can be a pair of bars perpendicular to the sliding weight 4, or half rectangle or half circle handles. The weight handles 5 may be attached to the sliding weight 4 with different handle attachment means including screws, bolts, or welds. The weight stops 3 may be raised portions of the nozzle tube 1 integrally formed when the tube was formed, or other shaped stops connected to the nozzle tube 1 by screws or welds. The nozzle tube 1 may have differing lengths depending on the thickness of the wall to be penetrated. The space between the weight stops 3 may vary depending on how much impact the sliding weight 4 must impart against the forward weight stop 3. The weight stops 3 could be one piece with the nozzle tube 1, or they may comprise a pair of pins or annular pieces of metal, which may be attached to nozzle tube 1 after nozzle tube 1 is formed. Pointed head 2 may have varying shapes, lengths and head angles, and may be made of various metals, and may be coated or plated with various hardening coatings including tungsten carbide. As for the head blade attachment means, the head blades 6 may be machined out of one piece of metal with pointed head 2, or head blades 6 may be inserted into slots machined into the outside surface of pointed head 2 or welded in place. The head blades 6 may have different shapes including triangular, trapezoidal, or triangle with curved leading edge. Typical dimensions of the device are shown in FIGS. 1 and 2; however, different dimensions may be used to optimize the penetration of wall of different thicknesses and resistances, or to make the device easier to handle and carry. The number of nozzle holes 7 in pointed head 2 can vary, as well as the angles of nozzle holes 7 with respect to pointed head 2 depending upon the spray pattern and spray volume desired to be emitted by the pointed head 2. The head blades 6 can vary in number and can vary in angular spacing around the axis of the pointed head 2. The insulating coating 9 on the tube, weights or handles can be applied by different methods including the use of adhesives, or spraying or dipping the parts in a liquid material which, when dried, will form the insulating coating on the surface of the parts. Various head attachment means known to those skilled in the art can be used to connect nozzle tube 1 and pointed head 2. This may include welding or brazing or use of mating screw threads formed on the outside of nozzle tube 1 and the inside of pointed head 2, or on the inside of nozzle tube 1 and the outside of pointed head 2. A number of other changes are possible to the materials and dimensions described above, while still remaining within the scope and spirit of the invention.

The specifics about the form of the invention described in this application are not intended to be limiting in scope. The scope of the invention is to be determined by the claims, and their legal equivalents, not the examples given above.

We claim:

1. A piercing nozzle used by an operator for penetrating a door, wall or similar barrier and injecting fluid beyond the barrier, comprising;

a. an elongated tube having a longitudinal axis with a source of pressurized fluid at one end, b. a pointed head having a hollow central cavity and attached to an opposite end of said tube, c. a sliding weight containing a hole through which said tube passes, and adapted to slide back and forth along the tube, d. at least one weight stop positioned on the tube between said sliding weight and the end of said tube nearest to the pointed head, e. a handle on said sliding weight, whereby the operator can move said sliding weight away from said weight stop, and then toward said weight stop, whereby the momentum and impact of said sliding weight against the weight stop gives a force to the pointed head and tube to penetrate a door, wall, or barrier; and f. a means for spraying a fluid in proximity to the pointed head.

2. The device of claim 1, wherein said pointed head is in a shape consisting of a cone, wherein the point of the cone is on the axis of said elongated hollow nozzle tube.

3. The device of claim 2, further comprising a plurality of head blades attached to the lateral surface of said cone, and positioned perpendicular to the surface of said cone to which they are attached.

4. The device of claim 3, wherein the shape of said head blades is a shape selected from the group consisting of a triangle, a trapezoid, or a triangle wherein the leading edge of said triangle is replaced by a concave curve.

5. The device of claim 1 wherein the perpendicular cross-section of said elongated hollow tube is a circle or polygon.

6. The device of claim 1, wherein the weight stop comprises a raised portion of the surface of said elongated hollow tube.

7. The device of claim 1 wherein the weight stop comprises one or more pins, or substantially annular or polygonal shaped collars, positioned perpendicular to the axis of said elongated hollow tube.

8. The device of claim 1, wherein said handle means has a shape selected from the group consisting of a semicircle, an open half rectangular, or a pair of rods attached to said sliding weight and perpendicular to the axis of said sliding weight and said elongated hollow tube.

9. The device of claim 1 wherein said sliding weight is substantially cylindrical or annular in shape.

10. The device of claim 1, wherein the spraying means comprises a plurality of holes in the pointed head, which holes are in fluid communication with the head cavity inside said pointed head, or the inside of said elongated hollow tube, respectively.

11. The device of claim 1, wherein the head attachment means comprises a weld or mating screw threads cut into the hollow tube and the rear of the pointed head.

12. The device of claim 1 wherein said stop is attached to the tube.

13. The device of claim 1, wherein a handle is attached to the weight by attachment means.

14. A piercing nozzle used by an operator for penetrating a door, wall or similar barrier, comprising:

a. an elongated hollow tube having an longitudinal axis and adapted to be connected at one end to a source of pressurized fluid, b. a pointed head attached to an opposite end of said elongated hollow tube, wherein an axis of said pointed head coincides with the axis of said elongated hollow nozzle tube, c. a sliding weight containing a hole through which said elongated hollow tube passes, and adapted to slide back and forth along the tube, d. one weight stop positioned between said sliding weight and the end of said elongated hollow nozzle tube nearest to the pointed head, and attached to said elongated hollow tube, e. a handle attached to said sliding weight, whereby the hands of an operator can grasp said handle and move said sliding weight attached thereto away from said weight stop, and then toward said weight stop, whereby the momentum and impact of said sliding weight against the weight stop generates force to the pointed head and elongated hollow tube and propels them through a door, wall, or barrier to be penetrated, and f. nozzle holes in said pointed head or tube for spraying a fluid from or near the pointed head.

15. The device of claim 10, wherein said holes are formed so as to release said fluid in a plurality of different directions with respect to the surface of the pointed head, or the surface of the nozzle tube.

16. The device of claim 3, wherein said blade attachment means comprises insertion of said blade into grooves or slots formed in the surface of the cone.

17. The device of claim 1, further comprising an electrically insulating coating applied to the surface of the tube.

18. The device of claim 2, further comprising a plurality of flat head blades, wherein said head blades are perpendicular to the lateral surface of said cone, and oriented so that planes defined by such head blades pass through a central axis of said pointed head.

19. The device of claim 14, wherein said holes are formed so as to release said fluid in a plurality of different directions with respect to the tube and head.

20. The device of claim 14, wherein the pointed head is attached to the opposite end of said elongated tube by mating screw threads.

* * * * *